US010916199B2

(12) United States Patent
Zhu et al.

(10) Patent No.: US 10,916,199 B2
(45) Date of Patent: Feb. 9, 2021

(54) DISPLAY PANEL AND DRIVING METHOD OF PIXEL CIRCUIT

(71) Applicant: Kunshan Go-Visionox Opto-Electronics Co., Ltd., Kunshan (CN)

(72) Inventors: Zhengyong Zhu, Kunshan (CN); Xiyang Jia, Kunshan (CN); Hui Zhu, Kunshan (CN)

( * ) Notice: Subject to any disclaimer, the term of this patent is extended or adjusted under 35 U.S.C. 154(b) by 0 days.

(21) Appl. No.: 16/846,398

(22) Filed: Apr. 12, 2020

(65) Prior Publication Data

US 2020/0243014 A1 Jul. 30, 2020

Related U.S. Application Data

(63) Continuation of application No. PCT/CN2019/078925, filed on Mar. 20, 2019.

(30) Foreign Application Priority Data

Sep. 28, 2018 (CN) ..... 2018 1 1139920

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01);
(Continued)

(58) Field of Classification Search
CPC .. G09G 3/3233; G09G 3/3258; G09G 3/3266; G09G 3/3275; G09G 2300/0426;
(Continued)

(56) References Cited

U.S. PATENT DOCUMENTS 8,803,770 B2 8/2014 Jeong et al.
10,565,932 B2 * 2/2020 Zhang ..... G09G 3/3233
(Continued)

FOREIGN PATENT DOCUMENTS

CN 101859542 A 10/2010
CN 102122490 A 7/2011
(Continued)

OTHER PUBLICATIONS

CN First Office Action dated Jun. 11, 2019 in the corresponding CN application(application No. 201811139920.6).
(Continued)

*Primary Examiner* — Nelson M Rosario
(74) *Attorney, Agent, or Firm* — Kilpatrick Townsend & Stockton

(57) ABSTRACT

The present application provides a display panel and a driving method of a pixel circuit. The display panel includes a scan driver, a light-emitting control driver, a data driver, a plurality of pixel circuits, and a plurality of pixels each corresponding to one of the pixel circuits. Each of the pixel circuits includes a first transistor to a seventh transistor, a capacitor and an organic light-emitting diode. A control terminal of the fourth transistor is configured to input a first scanning signal; and a first electrode of the fourth transistor is connected to a second electrode of the third transistor, a control terminal of the first transistor and a terminal of the capacitor. Another terminal of the capacitor is connected to a first electrode of a fifth transistor. A second electrode of the fourth transistor is configured to input a first reference voltage.

17 Claims, 5 Drawing Sheets

(52) U.S. Cl.
CPC ..... *G09G 2300/0426* (2013.01); *G09G 2330/021* (2013.01)

(58) Field of Classification Search
CPC ... G09G 2300/0819; G09G 2300/0842; G09G 2300/0861; G09G 2320/045; G09G 2330/021; G09G 3/20; G09G 3/32; G09G 3/3208; G09G 3/36; G09G 3/3611; G09G 3/3677; G09G 3/3688; G09G 5/02; G09G 2300/0452; G09G 2300/0814; G09G 2310/021; G09G 2310/0275; G09G 2310/0286; G09G 2310/0291; G09G 2310/0297; G09G 2310/08
See application file for complete search history.

(56) References Cited

U.S. PATENT DOCUMENTS

| | | | | |
|---|---|---|---|---|
| 2018/0033365 | A1* | 2/2018 | Zhang ..... | G09G 3/3291 |
| 2018/0144683 | A1 | 5/2018 | Shin | |
| 2018/0166025 | A1 | 6/2018 | Zhou et al. | |
| 2018/0308427 | A1 | 10/2018 | Zhang et al. | |
| 2019/0096327 | A1 | 3/2019 | Peng et al. | |

FOREIGN PATENT DOCUMENTS

| | | | |
|---|---|---|---|
| CN | 102314829 | A | 1/2012 |
| CN | 106128360 | A | 11/2016 |
| CN | 106991964 | A | 7/2017 |
| CN | 107154239 | A | 9/2017 |
| CN | 107358917 | A | 11/2017 |
| CN | 107610652 | A | 1/2018 |
| CN | 207217082 | U | 4/2018 |
| CN | 108428434 | A | 8/2018 |
| CN | 109243369 | A | 1/2019 |
| JP | 2004287046 | A | 10/2004 |
| WO | 2018188390 | A1 | 10/2018 |

OTHER PUBLICATIONS

CN Second Office Action dated Aug. 28, 2019 in the corresponding CN application(application No. 201811139920.6).

* cited by examiner

DISPLAY PANEL AND DRIVING METHOD OF PIXEL CIRCUIT

CROSS-REFERENCES TO RELATED APPLICATIONS

This application is a continuation application of international application PCT/CN2019/078925, entitled "DISPLAY PANELS AND DRIVING METHOD OF PIXEL CIRCUIT", and filed on Mar. 20, 2019, which claims the priority benefit of Chinese patent application No. 201811139920.6, entitled "DISPLAY PANEL, DRIVING METHOD OF PIXEL CIRCUIT AND DISPLAY DEVICE", and filed on Sep. 28, 2018. The entireties of these applications are incorporated by reference herein for all purposes.

TECHNICAL FIELD

The present application relates to the field of display technology.

BACKGROUND

Organic light-emitting displays are displays that use organic light-emitting diodes (OLEDs) as light-emitting devices. Compared with thin film transistor-liquid crystal displays (TFT-LCDs), the organic light-emitting displays have advantages of high contrast, wide viewing angle, low power consumption, small size, and the like. The brightness of an OLED is determined by a current generated by a driving thin film transistor (TFT) circuit.

SUMMARY

The present application provides a display panel and a driving method of a pixel circuit.

A display panel includes: a scan driver configured to supply scanning signals to corresponding scanning signal lines; the scanning signals including a first scanning signal, a second scanning signal, and a third scanning signal; a light-emitting control driver configured to supply light-emitting control signals to corresponding light-emitting control signal lines; a data driver configured to supply data voltages to corresponding data signal lines; a plurality of pixel circuits, each of the plurality of pixel circuits including a first transistor, a second transistor, a third transistor, a fourth transistor, a fifth transistor, a sixth transistor, a seventh transistor, a capacitor and an organic light-emitting diode; and a plurality of pixels each corresponding to one of the plurality of pixel circuits, each of the plurality of pixels being disposed at an intersection position of one of the scanning signal lines, one of the light-emitting control signal lines and one of the data signal lines; a control terminal of the fourth transistor is configured to input the first scanning signal; a first electrode of the fourth transistor is connected to a second electrode of the third transistor, a control terminal of the first transistor and one terminal of the capacitor; another terminal of the capacitor is connected to a first electrode of the fifth transistor; and a second electrode of the fourth transistor is configured to input a first reference voltage; a control terminal of the fifth transistor is configured to input one of the light-emitting control signals; the first electrode of the fifth transistor is configured to input a first power supply voltage; a second electrode of the fifth transistor is connected to a first electrode of the first transistor and a second electrode of the second transistor; a second electrode of the first transistor is connected to a first electrode of the third transistor and a first electrode of the sixth transistor; a control terminal of the third transistor is configured to input the second scanning signal; a control terminal of the second transistor is configured to input the second scanning signal; a first electrode of the second transistor is configured to input one of the data voltages; a control terminal of the sixth transistor is configured to input the one of the light-emitting control signals, and a second electrode of the sixth transistor is connected to a first electrode of the seventh transistor; a control terminal of the seventh transistor is configured to input the third scanning signal; the first electrode of the seventh transistor is connected to an anode of the organic light-emitting diode; a second electrode of the seventh transistor is configured to input a second reference voltage; and a cathode of the organic light-emitting diode is configured to input a second power supply voltage.

In one of the embodiments, the scan driver includes a first scan driving circuit, a second scan driving circuit, and a third scan driving circuit, and the first scanning signal is provided by the first scan driving circuit in the scan driver; the second scanning signal is provided by the second scan driving circuit in the scan driver; and the third scanning signal is provided by the third scan driving circuit in the scan driver.

In one of the embodiments, the second electrode of the fourth transistor is connected to the second electrode of the seventh transistor, and the first reference voltage is equal to the second reference voltage.

In one of the embodiments, the second reference voltage is less than the second power supply voltage.

In one of the embodiments, the first scanning signal, the second scanning signal and the third scanning signal have time sequences different from each other; there is no overlap between a low-level duration of the one of the light-emitting control signals and a low-level duration of the first scanning signal; and there is an overlap between a low-level duration of the one of the light-emitting control signals and a low-level duration of the third scanning signal.

In one of the embodiments, the first transistor to the seventh transistor are all p-type thin film transistors.

In one of the embodiments, the capacitor is an energy storage capacitor.

In one of the embodiments, the second transistor to the seventh transistor are all switching transistors, and the first transistor is a drive transistor.

In one of the embodiments, the plurality of pixels are arranged in an array.

In one of the embodiments, a control terminal of each of the first transistor to the seventh transistor is a gate thereof; a first electrode of each of the first transistor to the seventh transistor is a source thereof; and the second electrode of each of the first transistor to the seventh transistor is a drain thereof.

In one of the embodiments, the first transistor to the seventh transistor include any one of low temperature polysilicon thin film transistors, oxide semiconductor thin film transistors, and amorphous silicon thin film transistors.

A driving method of any one of the plurality of pixel circuits in the display panel above, includes: in a first initialization stage, setting the first scanning signal and the second scanning signal as high-level signals, and setting the third scanning signal and the one of the light-emitting control signals as low-level signals; in a second initialization stage, setting the first scanning signal, the second scanning signal and the one of the light-emitting control signals as high-level signals; and setting the third scanning signal as a low-level signal; in a third initialization stage, setting the first scanning signal as a low-level signal; setting the second scanning signal, the third scanning signal and the one of the light-emitting control signals as high-level signals; and initializing, by the first reference voltage, the control terminal of the first transistor; in a storage stage, setting the first scanning signal, the third scanning signal and the one of the light-emitting control signals as high-level signals; setting the second scanning signal as a low-level signal; and writing, by the one of the data voltages, a compensation voltage into the capacitor; and in a light-emitting stage, setting the first scanning signal, the second scanning signal and the third scanning signal as high-level signals; setting the one of the light-emitting control signals as a low-level signal; and applying the first power supply voltage to the organic light-emitting diode, enabling the organic light-emitting diode to emit light.

In one of the embodiments, the driving method further includes, in the first initialization stage, controlling, by the third scanning signal, the seventh transistor to turn on; and initializing, by the second reference voltage, the anode of the organic light-emitting diode.

In one of the embodiments, the driving method further includes, in the storage stage, controlling, by the one of the light-emitting control signals, the fifth transistor to be off; and controlling, by the second scanning signal, the second transistor to turn on; and a potential of the control terminal of the first transistor being equal to Vdata−|Vth|; and a potential of a second electrode plate of the capacitor connected to the control terminal of the first transistor being equal to Vdata−|Vth|, wherein, Vth is a threshold voltage of the first transistor, and Vdata is the one of the data voltages.

A driving method of any one of the plurality of pixel circuits in the display panel above, includes: in a first initialization stage, setting the first scanning signal as a low-level signal; setting the second scanning signal, the third scanning signal and the one of the light-emitting control signals as high-level signals; and initializing, by the first reference voltage, the control terminal of the first transistor; in a storage stage, setting the first scanning signal, the third scanning signal and the one of the light-emitting control signals as high-level signals; setting the second scanning signal as a low-level signal; and writing, by the one of the data voltages, a compensation voltage into the capacitor; in a second initialization stage, setting the first scanning signal, the second scanning signal and the one of the light-emitting control signals as high-level signals, and setting the third scanning signal as a low-level signal; in a third initialization stage, setting the first scanning signal and the second scanning signal as high-level signals, and setting the third scanning signal and the one of the light-emitting control signals as low-level signals; and in a light-emitting stage, setting the first scanning signal, the second scanning signal and the third scanning signal as high-level signals; setting the one of the light-emitting control signals as a low-level signal; and providing the first power supply voltage to the organic light-emitting diode, enabling the organic light-emitting diode to emit light.

In one of the embodiments, the driving method further includes, in the storage stage, controlling, by the one of the light-emitting control signals, the fifth transistor to be off; controlling, by the second scanning signal, the second transistor to turn on; and a potential of the control terminal of the first transistor being equal to Vdata−|Vth|; and a potential of the second electrode plate of the capacitor connected to the control terminal of the first transistor being equal to Vdata−|Vth|, wherein Vth is a threshold voltage of the first transistor, and Vdata is the one of the data voltages.

In one of the embodiments, the driving method further includes, in the second initialization stage, controlling, by the third scanning signal, the seventh transistor to turn on; and initializing, by the second reference voltage, the anode of the organic light-emitting diode.

In the above display panel and the driving method of a pixel circuit, the display panel includes a scan driver, a light-emitting control driver, a data driver, a plurality of pixel circuits and a plurality of pixels each corresponding to one of the plurality of pixel circuits. The plurality of pixels each disposed at an intersection position of one of the scanning signal lines, one of the light-emitting control signal lines and one of the data signal lines. Each of the pixel circuits includes a first transistor, a second transistor, a third transistor, a fourth transistor, a fifth transistor, a sixth transistor, a seventh transistor, a capacitor, and an organic light-emitting diode. The first scanning signal applied to the control terminal of the fourth transistor, the second scanning signal applied to the control terminal of the second transistor, and the third scanning signal applied to the control terminal of the seventh transistor can be respectively provided by different scan driving circuits in the scan driver. In the first initialization stage or the second initialization stage, the third scanning signal controls the seventh transistor to turn on, and the anode of the organic light-emitting diode is initialized by the second reference voltage; the one of the light-emitting control signals controls the fifth transistor to be off, so that no current flows through the first transistor, thereby solving the technical problem of rapid aging of the driving thin film transistor, and reducing the power consumption of the circuit and prolonging the service life of the driving thin film transistor.

DETAILED DESCRIPTION OF THE INVENTION

An active-matrix organic light-emitting diode (AMOLED) can be driven by a data voltage output from a driving circuit, and the data voltage is directly written into a pixel circuit to control the brightness of the pixel.

The applicant found that, a technical problem of rapid aging exists in the driving thin film transistor.

The embodiments of the present application will be described in detail as follows with reference to the accompanying drawings in order to make the objectives, features, and advantages of the present application more apparent and be easily understood. Numerous specific details are described in the following description to facilitate a full understanding of the present application. However, the present application can be implemented in many other ways different from those described herein, and those skilled in the art can make similar improvements without departing from the connotations of this application, therefore, the present application is not limited to the specific embodiments disclosed below.

Figure 1:
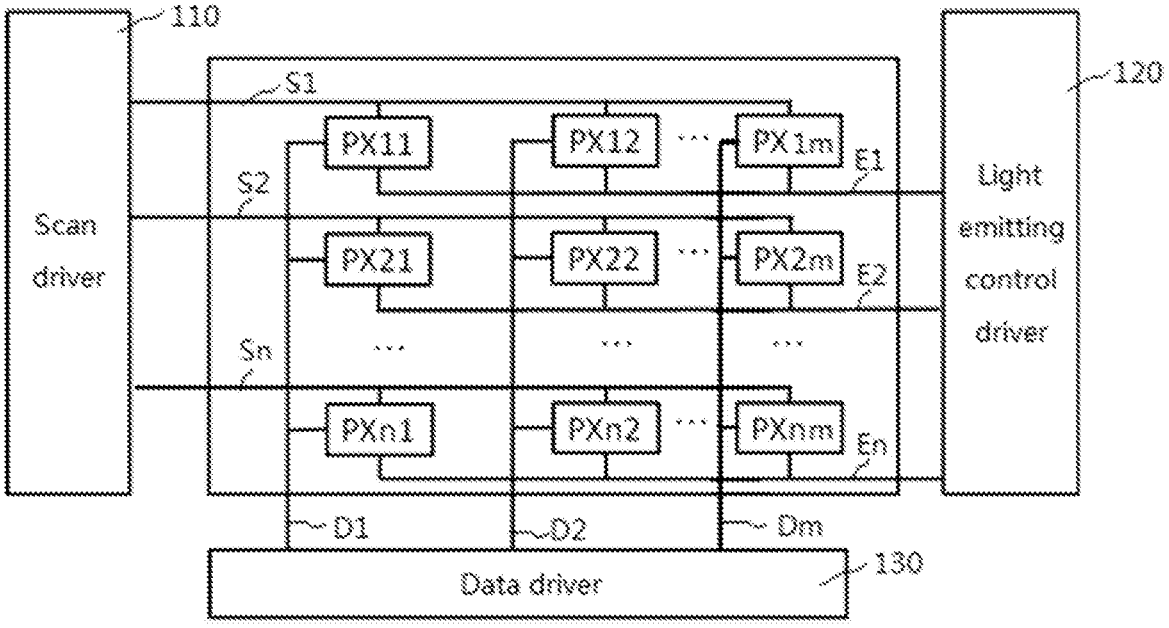
FIG. 1 is a schematic structural diagram of a display panel in an embodiment of the present application.

In an embodiment, referring to FIG. 1, the present application provides a display panel. The display panel includes:

a scan driver 110 configured to supply scanning signals to corresponding scanning signal lines, a light-emitting control driver 120 configured to supply light-emitting control signals to corresponding light-emitting control signal lines, and a data driver 130 configured to supply data voltages to corresponding data signal lines. The display panel further includes a plurality of pixel circuits, and a plurality of pixels each corresponding to one of the plurality of pixel circuits. The plurality of pixels each disposed at an intersection position of one of the scanning signal lines, one of the light-emitting control signal lines and one of the data signal lines. Specifically, the scan driver 110 is connected to a plurality of pixels PX11 to PXnm arranged in a matrix form by scanning signal lines S1 to Sn. The pixels PX11 to PXnm are also connected to light-emitting control signal lines E1 to En, and are further connected to the light-emitting control driver 120 by the light-emitting control signal lines E1 to En. The pixels PX11 to PXnm are also connected to data signal lines D1 to Dm, and are further connected to the data driver 130 through the data signal lines D1 to Dm. The light-emitting control signal lines E1 to En are substantially parallel to the scanning signal lines S1 to Sn. The light-emitting control signal lines E1 to En are substantially perpendicular to the data signal lines D1 to Dm.

Figure 2:
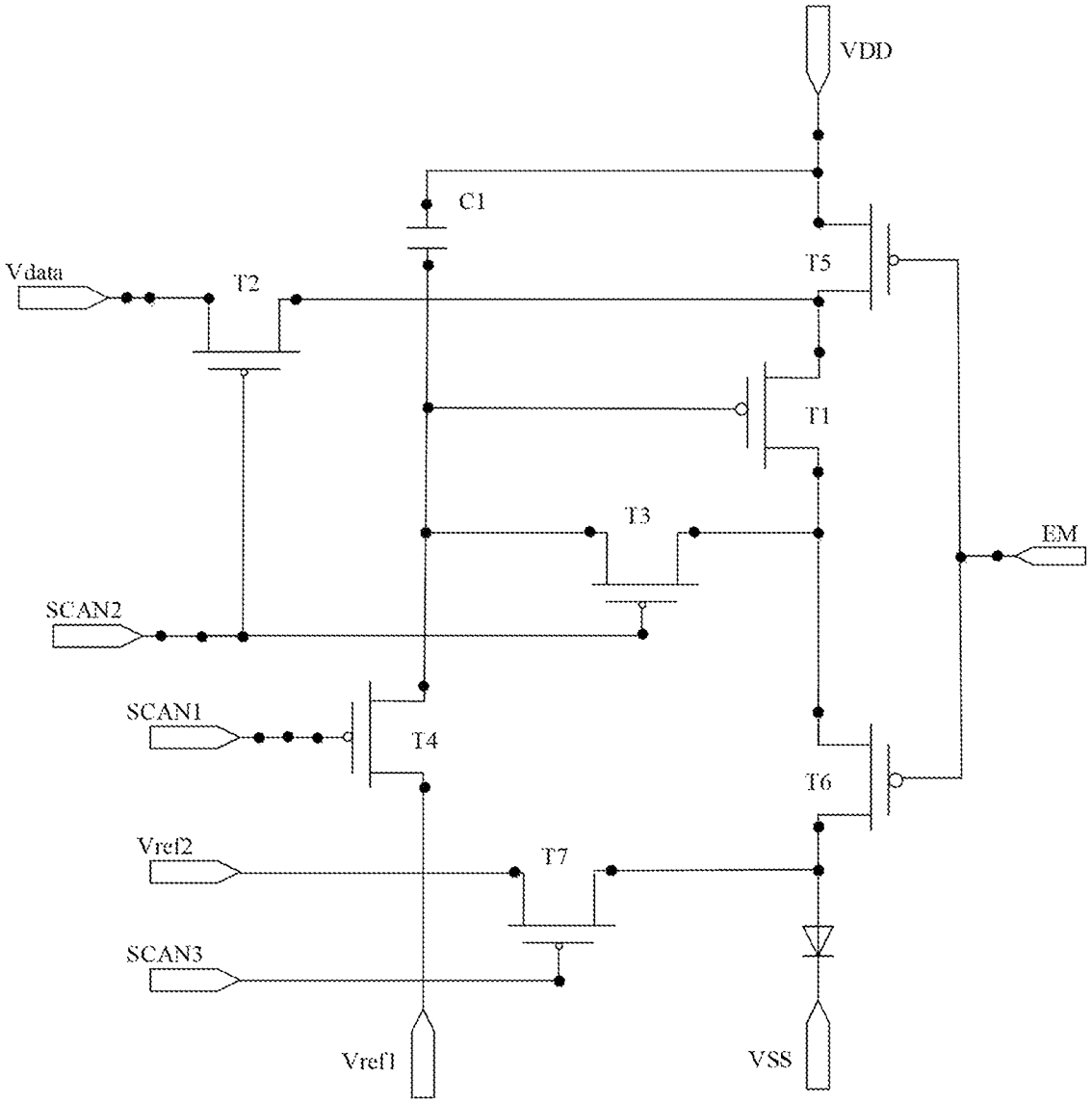
FIG. 2 is a circuit diagram of a pixel circuit in an embodiment of the present application.

Referring to FIG. 2, each pixel circuit includes a first transistor T1, a second transistor T2, a third transistor T3, a fourth transistor T4, a fifth transistor T5, a sixth transistor T6, a seventh transistor T7, a capacitor C1, and an organic light-emitting diode OLED. The first transistor T1 to the seventh transistor T7 each include a control terminal, a first electrode, and a second electrode.

Specifically, a control terminal of the fourth transistor T4 is configured to input the first scanning signal; a first electrode of the fourth transistor T4 is connected to a second electrode of the third transistor T3, a control terminal of the first transistor T1 and one terminal of the capacitor C1; another terminal of the capacitor C1 is connected to a first electrode of the fifth transistor T5; and a second electrode of the fourth transistor T4 is configured to input a first reference voltage Vref1.

A control terminal of the fifth transistor T5 is configured to input the light-emitting control signal; the first electrode of the fifth transistor T5 is configured to input a first power supply voltage VDD; and a second electrode of the fifth transistor T5 is connected to a first electrode of the first transistor T1 and a second electrode of the second transistor T2.

A second electrode of the first transistor T1 is connected to a first electrode of the third transistor T3 and a first electrode of the sixth transistor T6; and a control terminal of the third transistor T3 is configured to input a second scanning signal.

A control terminal of the second transistor T2 is configured to input the second scanning signal, and a first electrode of the second transistor T2 is configured to input a data voltage Vdata.

A control terminal of the sixth transistor T6 is configured to input the light-emitting control signal, and a second electrode of the sixth transistor T6 is connected to a first electrode of the seventh transistor T7.

A control terminal of the seventh transistor T7 is configured to input the third scanning signal; a first electrode of the seventh transistor T7 is connected to an anode of the organic light-emitting diode OLED; and a second electrode of the seventh transistor T7 is configured to input a second reference voltage Vref2.

A cathode of the organic light-emitting diode OLED is configured to input a second power supply voltage VSS.

In this embodiment, the first scanning signal, the second scanning signal, and the third scanning signal are respectively provided by different scan driving circuits in the scan driver. Specifically, the scan driver includes a first scan driving circuit, a second scan driving circuit, and a third scan driving circuit, and the first scanning signal is provided by the first scan driving circuit in the scan driver; the second scanning signal is provided by the second scan driving circuit in the scan driver; and the third scanning signal is provided by the third scan driving circuit in the scan driver.

In this embodiment, the second transistor T2, the third transistor T3, the fourth transistor T4, the fifth transistor T5, the sixth transistor T6, and the seventh transistor T7 are switching transistors in the pixel circuits. The first transistor T1 is a driving transistor in the pixel circuit. The capacitor C1 is an energy storage capacitor, and is connected between the control terminal of the first transistor T1 and the first electrode of the first transistor T1.

In this embodiment, the first scanning signal SCAN1 controls the fourth transistor T4 to be off or turn on; the third scanning signal SCAN3 controls the seventh transistor T7 to be off or turn on; and the second scanning signal SCAN2 controls the second transistor T2 and the third transistors T3 to be off or turn on. The light-emitting control signal EM controls the fifth transistor T5 and the sixth transistor T6 to be off or turn on. When the fourth transistor T4 turns on, the first reference voltage Vref1 initializes the control terminal of the first transistor T1 via the fourth transistor T4. When the seventh transistor T7 turns on, the second reference voltage Vref2 initializes the anode of the organic light-emitting diode OLED via the seventh transistor T7. When the fifth transistor T5 and the sixth transistor T6 turn on, the first power supply voltage VDD is applied to the organic light-emitting diode OLED via the fifth transistor T5, the first transistor T1 and the sixth transistor T6, and the organic light-emitting diode OLED emits light.

In this embodiment, after the third scanning signal controls the seventh transistor T7 to turn on, the second reference voltage Vref2 initializes the anode of the organic light-emitting diode OLED. The light-emitting control signal controls the fifth transistor T5 to be off, so that no current path is formed from a power supply terminal supplying the first power supply voltage VDD to a power supply terminal supplying the second reference voltage Vref2 via the first transistor T1, thereby reducing the power consumption of the circuits and delaying the aging of the first transistor T1, and further solving the technical problem of rapid aging of the driving thin film transistor. Further, the first scanning signal applied to the control terminal of the fourth transistor T4, the second scanning signal applied to the control terminal of the second transistor T2 and the third scanning signal applied to the control terminal of the seventh transistor T7 are respectively provided by different scan driving circuits in the scan driver, thereby reducing the output loads of different scan driving circuits in the scan driver, and ensuring the accuracy of the scanning signals output by each of the scan driving circuits.

In an embodiment, the second electrode of the fourth transistor T4 is connected to the second electrode of the seventh transistor T7, and the first reference voltage Vref1 is equal to the second reference voltage Vref2. Therefore, the first reference voltage Vref1 can share a same signal transmitting line with the second reference voltage Vref2, thereby reducing wires.

In an embodiment, the first transistor T1, the second transistor T2, the third transistor T3, the fourth transistor T4, the fifth transistor T5, the sixth transistor T6 and the seventh transistor T7 are any one of low temperature polysilicon thin film transistors, oxide semiconductor thin film transistors, and amorphous silicon thin film transistors. The first transistor T1, the second transistor T2, the third transistor T3, the fourth transistor T4, the fifth transistor T5, the sixth transistor T6 and the seventh transistor T7 can be, p-type thin film transistors or n-type thin film transistors. When a transistor in the pixel circuit is a p-type thin film transistor, a low-level signal is input to the control terminal of the transistor that needs to turn on; and when a transistor in the pixel circuit is an n-type thin film transistor, a high-level signal is input to the control terminal of the transistor that needs to turn on.

Figure 3:
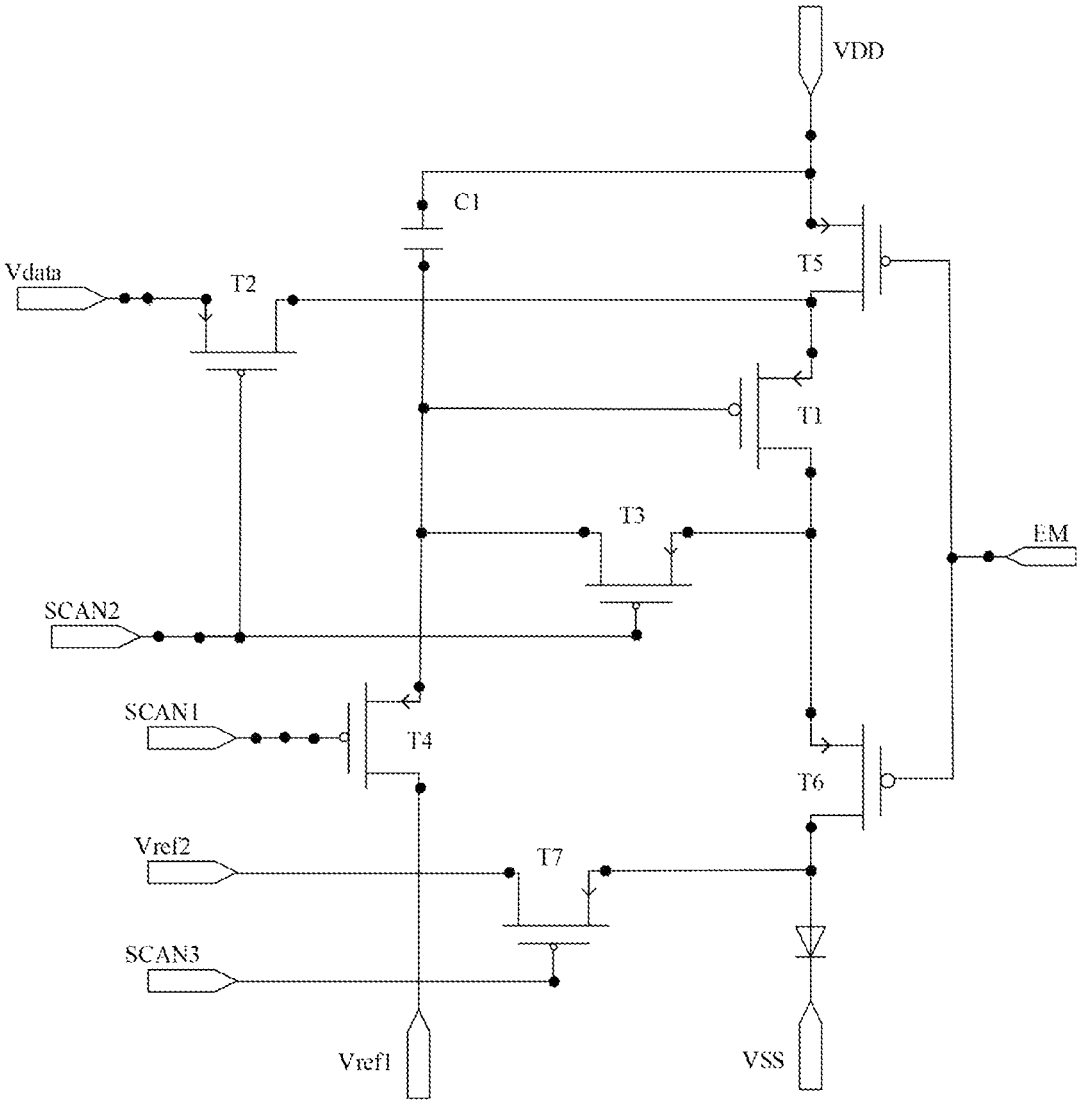
FIG. 3 is a circuit diagram of a pixel circuit using p-type thin film transistors in an embodiment of the present application.

In an embodiment of the present application, please refer to FIG. 3, the first transistor T1, the second transistor T2, the third transistor T3, the fourth transistor T4, the fifth transistor T5, the sixth transistor T6, and the seven transistors T7 in the pixel circuit are all p-type thin film transistors. The control terminal of each of the first transistor T1 to the seventh transistor T7 can be a gate of the transistor, the first electrode of each of the first transistor T1 to the seventh transistor T7 can be a source of the transistor, and the second electrode of each of the first transistor T1 to the seventh transistor T7 can be a drain of the transistor. For example, the control terminal of the first transistor T1 can be the gate of the first transistor T1, the first electrode of the first transistor T1 can be the source of the first transistor T1, and the second electrode of the first transistor T1 can be the drain of the first transistor T1.

In an embodiment, the second reference voltage Vref2 is lower than the second power supply voltage VSS. In a light-emitting stage, the first power supply voltage VDD is applied to the organic light-emitting diode OLED via the fifth transistor T5, the first transistor T1 and the sixth transistor T6, and the organic light-emitting diode OLED emits light. Under the effect of a forward current flowing through the organic light-emitting diode OLED, holes are concentrated, and the indium ions in indium tin oxide move, thus accelerating the aging of the organic light-emitting diode OLED. In an initialization stage, by setting the second reference voltage Vref2 to be lower than the second power supply voltage VSS, the organic light-emitting diode OLED is reverse-biased, which compensates for the aging of the organic light-emitting diode OLED during the light-emitting stage, thereby prolonging the service life of the organic light-emitting diode OLED.

In an embodiment, the first scanning signal SCAN1, the second scanning signal SCAN2 and the third scanning signal SCAN3 have different time sequences from each other. There is no overlap between the low-level duration of the light-emitting control signal EM and the low-level duration of the first scanning signal SCAN1. When the fourth transistor T4 turns on, the fifth transistor T5 is off. Therefore, while the control terminal of the first transistor T1 is being initialized, no current path will be formed from a power supply terminal supplying the first power supply voltage VDD to a power supply terminal supplying the second reference voltage Vref2 via the first transistor T1, thereby reducing the power consumption of the circuit. There is an overlap between the low-level duration of the light-emitting control signal EM and the low-level duration of the third scanning signal SCAN3, thereby reducing the pulse current flowing through the organic light-emitting diode OLED during the initialization process, and reducing the flicker and delaying the aging of the organic light-emitting diode OLED.

In this embodiment, the third scanning signal SCAN3 and the first scanning signal SCAN1 are designed separately, that is, respectively provided by different scan driving circuits in the scan driver, which makes the circuit design more flexible. The third scanning signal SCAN3 can be designed to be the same as the first scanning signal SCAN1, or can be designed to be the same as the second scanning signal SCAN2, according to actual requirements. In addition, in a large-sized display screen, in order to reduce the impedance of the output terminal of the scanning circuit, the timing signals of the third scanning signal SCAN3, the first scanning signal SCAN1 and the second scanning signal SCAN2 can be different from each other, and the first scanning signal SCAN1, the second scanning signal SCAN2 and the third scanning signal SCAN3 can be provided by different scan driving circuits, thereby reducing the output loads of the scan driving circuits, ensuring the accuracy of the scanning signals output by the scan driving circuits, and effectively solving the problem of delay of the scanning signals and the technical problem in the large-sized and high-resolution display panels.

In an embodiment, the present application provides a driving method based on the pixel circuit of the display panel in any one of the above embodiments, and the driving method includes:

In a first initialization stage t1, the first scanning signal SCAN1 and the second scanning signal SCAN2 are both high-level signals, and the third scanning signal SCAN3 and the light-emitting control signal EM are both low-level signals.

In a second initialization stage t2, the first scanning signal SCAN1, the second scanning signal SCAN2 and the light-emitting control signal EM are all high-level signals, and the third scanning signal SCAN3 is a low-level signal.

In a third initialization stage t3, the first scanning signal SCAN1 is a low-level signal, and the second scanning signal SCAN2, the third scanning signal SCAN3 and the light-emitting control signal EM are all high-level signals. The first reference voltage Vref1 initializes the control terminal of the first transistor T1.

In a storage stage t4, the first scanning signal SCAN1, the third scanning signal SCAN3 and the light-emitting control signal EM are all high-level signals, and the second scanning signal SCAN2 is a low-level signal; the data voltage Vdata writes a compensation voltage into the capacitor C1.

In a light-emitting stage t5, the first scanning signal SCAN1, the second scanning signal SCAN2 and the third scanning signal SCAN3 are all high-level signals, and the light-emitting control signal EM is a low-level signal. The first power supply voltage VDD is applied to the organic light-emitting diode OLED, and the organic light-emitting diode OLED emits light.

Figure 4:
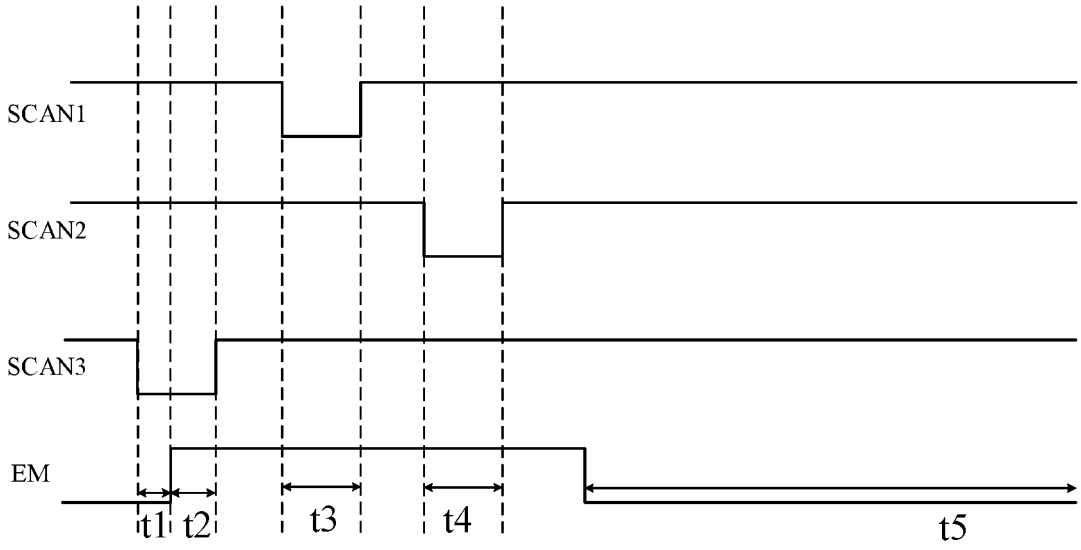
FIG. 4 is a timing diagram of a driving method in an embodiment of the present application.

Please refer to FIG. 4, which is a timing diagram of signals corresponding to the driving method. The timing diagram of signals includes the first initialization stage t1, the second initialization stage t2, the third initialization stage t3, the storage stage t4, and the light-emitting stage t5. The specific working process is as follows.

In the first initialization stage t1, the first scanning signal SCAN1 and the second scanning signal SCAN2 are both high-level signals, and the second transistor T2, the third transistor T3 and the fourth transistor T4 are off. The third scanning signal SCAN3 is a low-level signal, and the seventh transistor T7 turns on, then the second reference voltage Vref2 initializes the anode of the organic light-emitting diode OLED. The light-emitting control signal EM is a low-level signal, and the fifth transistor T5 and the sixth transistor T6 turn on. Since the seventh transistor T7, the fifth transistor T5 and the sixth transistor T6 turn on, a current path is formed from a power supply terminal supplying the first power supply voltage VDD to a power supply terminal supplying the second reference voltage Vref2 via the fifth transistor T5, the first transistor T1, the sixth transistor T6 and the seventh transistor T7. Since no driving current flows through the organic light-emitting diode OLED, the organic light-emitting diode OLED does not emit light, which prolongs the service life of the organic light-emitting diode OLED.

In the second initialization stage t2, the first scanning signal SCAN1 and the second scanning signal SCAN2 are both high-level signals, and the second transistor T2, the third transistor T3 and the fourth transistor T4 are off. The third scanning signal SCAN3 is a low-level signal, and the seventh transistor T7 turns on. The light-emitting control signal EM is a high-level signal, and the fifth transistor T5 and the sixth transistor T6 are off. When the light-emitting control signal EM is changed from a low-level signal to a high-level signal, a potential of the anode of the organic light-emitting diode OLED becomes high, and a voltage difference is generated between the anode and the cathode of the organic light-emitting diode OLED due to capacitive coupling, then a pulse current can be generated to flow through the organic light-emitting diode OLED. However, the seventh transistor T7 turns on, and the second reference voltage Vref2 is lower than the second power supply voltage VSS, therefore no current flows through the organic light-emitting diode OLED, and there is no pulse current flowing through the organic light-emitting diode OLED, thereby reducing the flickers of light-emitting brightness of the organic light-emitting diode OLED in time of each image frame and delaying the aging of the OLED.

In the third initialization stage t3, the first scanning signal SCAN1 is a low-level signal; the fourth transistor T4 turns on; and the first reference voltage Vref1 initializes the control terminal of the first transistor T1. A first electrode plate of the capacitor C1 is connected to the power supply terminal providing the first power supply voltage VDD; a second electrode plate of the capacitor C1 is connected to the control terminal of the first transistor T1; a potential of the first electrode plate of the capacitor C1 is equal to first power supply voltage VDD, and a potential of the second electrode plate of the capacitor C1 is equal to the first reference voltage Vref1. The second scanning signal SCAN2, the third scanning signal SCAN3 and the light-emitting control signal EM are all high-level signals. The second transistor T2, the third transistor T3, the fifth transistor T5, the sixth transistor T6 and the seventh transistor T7 are all off.

In the storage stage t4, the first scanning signal SCAN1, the third scanning signal SCAN3 and the light-emitting control signal EM are all high-level signals, and the fourth transistor T4, the fifth transistor T5, the sixth transistor T6 and the seventh transistor T7 are all off. The second scanning signal SCAN2 is a low-level signal, and the second transistor T2 and the third transistor T3 turn on. The data voltage Vdata writes a compensation voltage into the capacitor C1.

Specifically, the light-emitting control signal EM controls the fifth transistor T5 to be off; the second scanning signal SCAN2 controls the second transistor T2 to turn on; and the potential of the first electrode of the first transistor T1 is equal to the data voltage Vdata. The potential of the control terminal of the first transistor T1 is equal to Vdata−|Vth|, wherein, Vth is a threshold voltage of the first transistor T1. The control terminal of the first transistor T1 is connected to the second electrode plate of the capacitor C1, and the potential of the second electrode plate of the capacitor C1 is equal to Vdata−|Vth|, thus writing the compensation voltage |Vth| into the capacitor C1.

In the light-emitting stage t5, the first scanning signal SCAN1, the second scanning signal SCAN2 and the third scanning signal SCAN3 are all high-level signals; the fourth transistor T4 and the seventh transistor T7 are off; and the second transistor T2 and the third transistor T3 are off. The light-emitting control signal EM is a low-level signal; the fifth transistor T5 and the sixth transistor T6 turn on; and the first power supply voltage VDD is applied to the organic light-emitting diode OLED via the fifth transistor T5, the first transistor T1 and the sixth transistor T6, thus enabling the organic light-emitting diode OLED to emit light.

In an embodiment, the present application provides a driving method based on the pixel circuit of the display panel in any one of the above embodiments, and the driving method includes:

In a first initialization stage t1, the first scanning signal SCAN1 is a low-level signal; the second scanning signal SCAN2, the third scanning signal SCAN3 and the light-emitting control signal EM are all high-level signals; and the first reference voltage Vref1 initializes the control terminal of the first transistor T1.

In a storage stage t2, the first scanning signal SCAN1, the third scanning signal SCAN3 and the light-emitting control signal EM are all high-level signals; the second scanning signal SCAN2 is a low-level signal; and the data voltage Vdata writes a compensation voltage into the capacitor C1.

In a second initialization stage t3, the first scanning signal SCAN1, the second scanning signal SCAN2 and the light-emitting control signal EM are high-level signals, and the third scanning signal SCAN3 is a low-level signal.

In a third initialization stage t4, the first scanning signal SCAN1 and the second scanning signal SCAN2 are both high-level signals, and the third scanning signal SCAN3 and the light-emitting control signal EM are both low-level signals.

In a light-emitting stage t5, the first scanning signal SCAN1, the second scanning signal SCAN2 and the third scanning signal SCAN3 are all high-level signals, and the light-emitting control signal EM is a low-level signal; the first power supply voltage VDD is applied to the organic light-emitting diode OLED, and the organic light-emitting diode OLED emits light.

Figure 5:
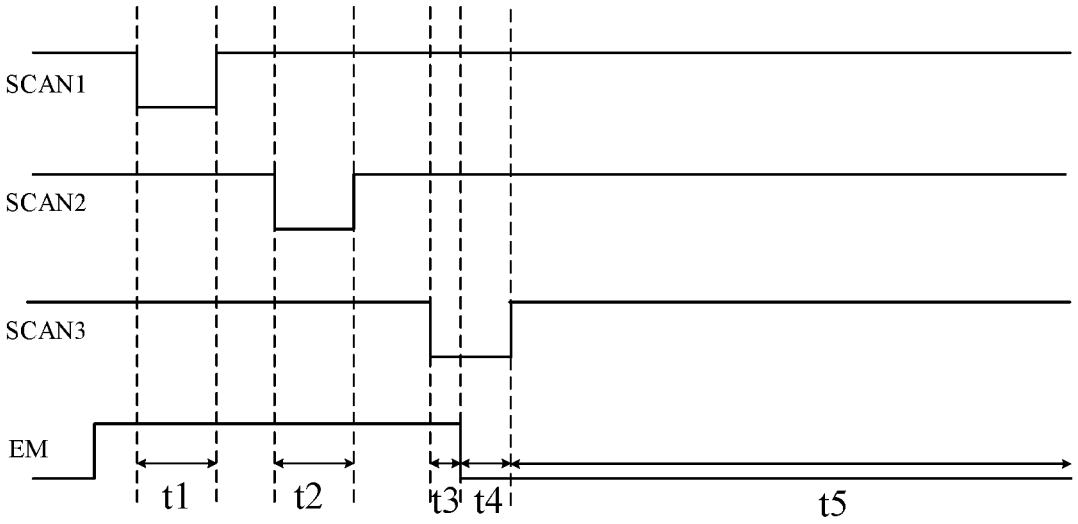
FIG. 5 is a timing diagram of a driving method in another embodiment of the present application.

FIG. 5 is a timing diagram of signals corresponding to the driving method. The timing diagram of signals includes a first initialization stage t1, a storage stage t2, a second initialization stage t3, a third initialization stage t4 and a light-emitting stage t5. The specific working process is as follows:

In the first initialization stage t1, the first scanning signal SCAN1 is a low-level signal; the fourth transistor T4 turns on; and the first reference voltage Vref1 initializes the control terminal of the first transistor T1. A first electrode plate of the capacitor C1 is connected to the power supply terminal providing the first power supply voltage VDD, and a second electrode plate of the capacitor C1 is connected to the control terminal of the first transistor T1; the potential of the first electrode plate of the capacitor C1 is equal to the first power supply voltage VDD, and the potential of the second electrode plate of the capacitor C1 is equal to the first reference voltage Vref1. The second scanning signal SCAN2, the third scanning signal SCAN3 and the light-emitting control signal EM are all high-level signals; and the second transistor T2, the third transistor T3, the fifth transistor T5, the sixth transistor T6 and the seventh transistor T7 are all off.

In the storage stage t2, the first scanning signal SCAN1, the third scanning signal SCAN3 and the light-emitting control signal EM are all high-level signals; the fourth transistor T4, the fifth transistor T5, the sixth transistor T6 and the seventh transistor T7 are off. The second scanning signal SCAN2 is a low-level signal, and the second transistor T2 and the third transistor T3 turn on. The data voltage Vdata writes a compensation voltage into the capacitor C1.

Specifically, the light-emitting control signal EM controls the fifth transistor T5 to be off; the second scanning signal SCAN2 controls the second transistor T2 to turn on; and the potential of the first electrode of the first transistor T1 is equal to the data voltage Vdata. The potential of the control terminal of the first transistor T1 is equal to Vdata−|Vth|. The control terminal of the first transistor T1 is connected to the second electrode plate of the capacitor C1; the potential of the second electrode plate of the capacitor C1 is equal to Vdata−|Vth|, thus writing the compensation voltage |Vth| into the capacitor C1.

In the second initialization stage t3, the first scanning signal SCAN1 and the second scanning signal SCAN2 are both high-level signals; the second transistor T2, the third transistor T3 and the fourth transistor T4 are off. The third scanning signal SCAN3 is a low-level signal; the seventh transistor T7 turns on; and the second reference voltage Vref2 initializes the anode of the organic light-emitting diode OLED. The light-emitting control signal EM is a high-level signal, and the fifth transistor T5 and the sixth transistor T6 are off.

In the third initialization stage t4, the first scanning signal SCAN1 and the second scanning signal SCAN2 are both high-level signals, and the second transistor T2, the third transistor T3 and the fourth transistor T4 are off. The third scanning signal SCAN3 is a low-level signal; the seventh transistor T7 turns on; and the second reference voltage Vref2 continues to initialize the anode of the organic light-emitting diode OLED. The light-emitting control signal EM is a low-level signal; the fifth transistor T5 and the sixth transistor T6 turn on; and a current path is formed from the power supply terminal supplying the first power supply voltage VDD to the power supply terminal supplying the second reference voltage Vref2 via the fifth transistor T5, the first transistor T1, the sixth transistor T6 and the seventh transistor T7. Since no driving current flows through the organic light-emitting diode OLED, the organic light-emitting diode OLED does not emit light, which prolongs the service life of the organic light-emitting diode OLED.

In the light-emitting stage t5, the first scanning signal SCAN1, the second scanning signal SCAN2 and the third scanning signal SCAN3 are all high-level signals; the fourth transistor T4 and the seventh transistor T7 are off; and the second transistor T2 and the third transistor T3 are off. The light-emitting control signal EM is a low-level signal; the fifth transistor T5 and the sixth transistor T6 turn on; and the first power supply voltage VDD is applied to the organic light-emitting diode OLED via the fifth transistor T5, the first transistor T1, and the sixth transistor T6, thus enabling the organic light-emitting diode OLED to emit light.

In an embodiment, please refer to FIG. 3 and FIG. 5, where FIG. 5 is a timing diagram of signals corresponding to the driving method, and the timing diagram of signals includes a first initialization stage t1, a storage stage t2, a second initialization stage t3, a third initialization stage t4 and a light-emitting stage t5. The specific working process is as follows:

In the first initialization stage t1, the first scanning signal SCAN1 is a low-level signal; the fourth transistor T4 turns on; and the first reference voltage Vref1 initializes the gate electrode of the first transistor T1. A first electrode plate of the capacitor C1 is connected to a power supply terminal providing the first power supply voltage VDD; a second electrode plate of the capacitor C1 is connected to the gate of the first transistor T1; the potential of the first electrode plate of the capacitor C1 is equal to VDD; and the potential of the second electrode plate of the capacitor C1 is equal to Vref1. The second scanning signal SCAN2, the third scanning signal SCAN3 and the light-emitting control signal EM are all high-level signals; and the second transistor T2, the third transistor T3, the fifth transistor T5, the sixth transistor T6 and the seventh transistor T7 are all off.

Specifically, the first scanning signal SCAN1 is a low-level signal; the light-emitting control signal EM is a high-level signal; and there is no overlap between the first scanning signal SCAN1 and the light-emitting control signal EM, that is, during the initialization of the gate of the first transistor T1, the fifth transistor T5 is off, and no current is generated to flow through the first transistor T1, thereby reducing the power consumption of the circuit. Specifically, since the resistance of the first transistor T1 is relatively small, if an overlap exists between the first scanning signal SCAN1 and the light-emitting control signal EM, for example, the first scanning signal SCAN1 and the light-emitting control signal EM are both low level at the same time, then a loop current will be generated to flow from the power supply terminal supplying the first power supply voltage VDD to the power supply terminal supplying the second reference voltage Vref2 via the first transistor T1 is larger, thus easily causing the aging of the first transistor T1 and increasing the power consumption of the circuit.

In the storage stage t2, the first scanning signal SCAN1, the third scanning signal SCAN3 and the light-emitting control signal EM are all high-level signals; the fourth transistor T4, the fifth transistor T5, the sixth transistor T6 and the seventh transistor T7 are all off; the second scanning signal SCAN2 is a low-level signal; and the second transistor T2 and the third transistor T3 turn on. The data voltage Vdata is applied to the source of the first transistor T1 via the second transistor T2 till the first transistor T1 is in a critical state. The potential of the source of the first transistor T1 is equal to the data voltage Vdata, and the potential of the gate of the first transistor T1 is equal to Vdata−|Vth|. Since the gate of the first transistor T1 is connected to the second electrode plate of the capacitor C1, the compensation voltage |Vth| is written into the capacitor C1.

At this time, the gate voltage of the first transistor T1 is Vdata−|Vth|, where Vth is the threshold voltage of the first transistor T1, and the value of the threshold voltage is negative, then the gate voltage of the first transistor T1 is Vdata+Vth.

In the second initialization stage t3, the first scanning signal SCAN1 is a high-level signal, and the fourth transistor T4 is off. The second scanning signal SCAN2 is a high-level signal, and the second transistor T2 and the third transistor T3 are off. The third scanning signal SCAN3 is a low-level signal; the seventh transistor T7 turns on; and the second reference voltage Vref2 initializes the anode of the organic light-emitting diode OLED. The light-emitting control signal EM is a high-level signal, and the fifth transistor T5 and the sixth transistor T6 are off. In the third initialization stage t4, the first scanning signal SCAN1 and the second scanning signal SCAN2 are both high-level signals, and the second transistor T2, the third transistor T3 and the fourth transistor T4 are off. The third scanning signal SCAN3 is a low-level signal; the seventh transistor T7 turns on; and the second reference voltage Vref2 continues to initialize the anode of the organic light-emitting diode OLED. The light-emitting control signal EM is a low-level signal, and the fifth transistor T5 and the sixth transistor T6 turn on. Since the seventh transistor T7, the fifth transistor T5 and the sixth transistor T6 turn on, a current path is formed from the power supply terminal supplying the first power supply voltage VDD to the power supply terminal supplying the second reference voltage Vref2 via the fifth transistor T5, the first transistor T1, the sixth transistor T6 and the seventh transistor T7. Since no driving current flows through the organic light-emitting diode OLED, the organic light-emitting diode OLED does not emit light, thereby prolonging the service life of the organic light-emitting diode OLED.

Specifically, the third scanning signal SCAN3 is a low-level signal; the lighting control signal EM is changed from a high-level signal to a low-level signal; and an overlap is arranged between the low level of the third scanning signal SCAN3 and the low level of the light-emitting control signal EM. Owing to capacitive coupling, the potential of the anode of the organic light-emitting diode OLED becomes high, and a voltage difference exists between the anode and the cathode of the organic light-emitting diode OLED, then a pulse current can be generated to flow through organic light-emitting diode OLED. However, the seventh transistor T7 turns on, and the second reference voltage Vref2 is lower than the second power supply voltage VSS, therefore no current flows through the organic light-emitting diode OLED, thereby reducing the flickers of light-emitting brightness of the organic light-emitting diode OLED in time of each image frame, and delaying the aging of the OLED.

In the light-emitting stage t5, the first scanning signal SCAN1, the second scanning signal SCAN2 and the third scanning signal SCAN3 are all high-level signals; the fourth transistor T4 and the seventh transistor T7 are off; and the second transistor T2 and the third transistor T3 are off. The light-emitting control signal EM is a low-level signal; the fifth transistor T5 and the sixth transistor T6 turn on; and the first power supply voltage VDD is applied to the organic light-emitting diode OLED via the fifth transistor T5, the first transistor T1 and the sixth transistor T6, thereby enabling the organic light-emitting diode OLED to emit light.

The gate-to-source voltage drop of the first transistor T1 is: Vgs=Vg−Vs; Vgs=Vdata+Vth−VDD.

The driving current flowing through the first transistor T1 is:

$$I=K*(Vgs-Vth)^2=K*(VDD-V\text{data})^2;$$

wherein K=½*μ*Cox*W/L; μ is the electron mobility of the first transistor; Cox is the gate oxide layer capacitance per unit area of the first transistor; W is the channel width of the first transistor; and L is the channel length of the first transistor.

Therefore, it can be obtained that the driving current through the first transistor T1 is:

$$I=\tfrac{1}{2}*\sim*Cox*W/L*(VDD-V\text{data})^2$$

It can be obtained from the above formula that the driving current through the first transistor T1 is independent of the threshold voltage Vth of the first transistor T1, thereby achieving the threshold voltage compensation, and making the brightness of the organic light-emitting diode OLED stable.

In an embodiment, the present application provides a display device including the display panel of any one of the above embodiments.

The technical features of the above-described embodiments can be arbitrarily combined. For the sake of brevity of description, not all possible combinations of the technical features of the embodiments are described. However, as long as no contradiction occurs in the combinations of these technical features, the combinations should be considered to be in the scope of the specification of the present application.

The above embodiments merely illustrate several implementations of this application, and the description thereof is more specific and detailed, but shall not be constructed as limitations to the protection scope of the present application. It should be noted that, for a person of ordinary skill in the art, several variations and improvements can be made without departing from the concept of this application, and these variations and improvements are all within the protection scope of this application. Therefore, the protection scope of this application should be defined by the appended claims.

The invention claimed is:

1. A display panel, comprising:

a scan driver configured to supply scanning signals to corresponding scanning signal lines, the scanning signals comprising a first scanning signal, a second scanning signal, and a third scanning signal;

a light-emitting control driver configured to supply light-emitting control signals to corresponding light-emitting control signal lines;

a data driver configured to supply data voltages to corresponding data signal lines;

a plurality of pixel circuits, each of the plurality of pixel circuits comprising a first transistor, a second transistor, a third transistor, a fourth transistor, a fifth transistor, a sixth transistor, a seventh transistor, a capacitor, and an organic light-emitting diode; and a plurality of pixels each corresponding to one of the plurality of pixel circuits, each of the plurality of pixels being disposed at an intersection position of one of the scanning signal lines, one of the light-emitting control signal lines and one of the data signal lines;

wherein, a control terminal of the fourth transistor is configured to input the first scanning signal; a first electrode of the fourth transistor is connected to a second electrode of the third transistor, a control terminal of the first transistor and one terminal of the capacitor; another terminal of the capacitor is connected to a first electrode of the fifth transistor; and a second electrode of the fourth transistor is configured to input a first reference voltage;

a control terminal of the fifth transistor is configured to input one of the light-emitting control signals; the first electrode of the fifth transistor is configured to input a first power supply voltage; a second electrode of the fifth transistor is connected to a first electrode of the first transistor and a second electrode of the second transistor;

a second electrode of the first transistor is connected to a first electrode of the third transistor and a first electrode of the sixth transistor; a control terminal of the third transistor is configured to input the second scanning signal;

a control terminal of the second transistor is configured to input the second scanning signal; a first electrode of the second transistor is configured to input one of the data voltages;

a control terminal of the sixth transistor is configured to input the one of the light-emitting control signals, and a second electrode of the sixth transistor is connected to a first electrode of the seventh transistor;

a control terminal of the seventh transistor is configured to input the third scanning signal; the first electrode of the seventh transistor is connected to an anode of the organic light-emitting diode; a second electrode of the seventh transistor is configured to input a second reference voltage; and a cathode of the organic light-emitting diode is configured to input a second power supply voltage.

2. The display panel according to claim 1, wherein the scan driver includes a first scan driving circuit, a second scan driving circuit, and a third scan driving circuit, and the first scanning signal is provided by the first scan driving circuit in the scan driver; the second scanning signal is provided by the second scan driving circuit in the scan driver; and the third scanning signal is provided by the third scan driving circuit in the scan driver.

3. The display panel according to claim 1, wherein the second electrode of the fourth transistor is connected to the second electrode of the seventh transistor, and the first reference voltage is equal to the second reference voltage.

4. The display panel according to claim 1, wherein the second reference voltage is less than the second power supply voltage.

5. The display panel according to claim 1, wherein, the first scanning signal, the second scanning signal and the third scanning signal have time sequences different from each other;

there is no overlap between a low-level duration of the one of the light-emitting control signals and a low-level duration of the first scanning signal; and there is an overlap between a low-level duration of the one of the light-emitting control signals and a low-level duration of the third scanning signal.

6. The display panel according to claim 1, wherein the first transistor to the seventh transistor are all p-type thin film transistors.

7. The display panel according to claim 1, wherein the capacitor is an energy storage capacitor.

8. The display panel according to claim 1, wherein the second transistor to the seventh transistor are all switching transistors, and the first transistor is a drive transistor.

9. The display panel according to claim 1, wherein the plurality of pixels are arranged in an array.

10. The display panel according to claim 1, wherein a control terminal of each of the first transistor to the seventh transistor is a gate thereof; a first electrode of each of the first transistor to the seventh transistor is a source thereof; and the second electrode of each of the first transistor to the seventh transistor is a drain thereof.

11. The display panel according to claim 1, wherein the first transistor to the seventh transistor comprise any one of low temperature polysilicon thin film transistors, oxide semiconductor thin film transistors, and amorphous silicon thin film transistors.

12. A driving method of any one of the plurality of pixel circuits in the display panel of claim 1, comprising:

in a first initialization stage, setting the first scanning signal and the second scanning signal as high-level signals, and setting the third scanning signal and the one of the light-emitting control signals as low-level signals;

in a second initialization stage, setting the first scanning signal, the second scanning signal and the one of the light-emitting control signals as high-level signals; and setting the third scanning signal as a low-level signal;

in a third initialization stage, setting the first scanning signal as a low-level signal; setting the second scanning signal, the third scanning signal and the one of the light-emitting control signals as high-level signals; and initializing, by the first reference voltage, the control terminal of the first transistor;

in a storage stage, setting the first scanning signal, the third scanning signal and the one of the light-emitting control signals as high-level signals; setting the second scanning signal as a low-level signal; and writing, by the one of the data voltages, a compensation voltage into the capacitor; and in a light-emitting stage, setting the first scanning signal, the second scanning signal and the third scanning signal as high-level signals; setting the one of the light-emitting control signals as a low-level signal; and applying the first power supply voltage to the organic light-emitting diode, enabling the organic light-emitting diode to emit light.

13. The driving method according to claim 12, further comprising, in the first initialization stage, controlling, by the third scanning signal, the seventh transistor to turn on; and initializing, by the second reference voltage, the anode of the organic light-emitting diode.

14. The driving method according to claim 13, further comprising, in the storage stage, controlling, by the one of the light-emitting control signals, the fifth transistor to be off; and controlling, by the second scanning signal, the second transistor to turn on; a potential of the control terminal of the first transistor being equal to Vdata−|Vth|; and a potential of a second electrode plate of the capacitor connected to the control terminal of the first transistor being equal to Vdata−|Vth|, wherein, Vth is a threshold voltage of the first transistor, and Vdata is the one of the data voltages.

15. A driving method for one of the plurality of pixel circuits in the display panel of claim 1, comprising:

in a first initialization stage, setting the first scanning signal as a low-level signal; setting the second scanning signal, the third scanning signal and the one of the light-emitting control signals as high-level signals; and initializing, by the first reference voltage, the control terminal of the first transistor;

in a storage stage, setting the first scanning signal, the third scanning signal and the one of the light-emitting control signals as high-level signals; setting the second scanning signal as a low-level signal; and writing, by the one of the data voltages, a compensation voltage into the capacitor;

in a second initialization stage, setting the first scanning signal, the second scanning signal and the one of the light-emitting control signals as high-level signals, and setting the third scanning signal as a low-level signal;

in a third initialization stage, setting the first scanning signal and the second scanning signal as high-level signals, and setting the third scanning signal and the one of the light-emitting control signals as low-level signals; and in a light-emitting stage, setting the first scanning signal, the second scanning signal and the third scanning signal as high-level signals; setting the one of the light-emitting control signals as a low-level signal; and providing the first power supply voltage to the organic light-emitting diode, enabling the organic light-emitting diode to emit light.

16. The driving method according to claim 15, further comprising, in the storage stage, controlling, by the one of the light-emitting control signals, the fifth transistor to be off;

controlling, by the second scanning signal, the second transistor to turn on; and a potential of the control terminal of the first transistor being equal to Vdata−|Vth|; and a potential of the second electrode plate of the capacitor connected to the control terminal of the first transistor being equal to Vdata−|Vth|, wherein Vth is a threshold voltage of the first transistor, and Vdata is the one of the data voltages.

17. The driving method according to claim 16, further comprising, in the second initialization stage, controlling, by the third scanning signal, the seventh transistor to turn on; and initializing, by the second reference voltage, the anode of the organic light-emitting diode.

* * * * *